US009193026B2

(12) United States Patent
Schwandner

(10) Patent No.: US 9,193,026 B2
(45) Date of Patent: Nov. 24, 2015

(54) METHOD FOR POLISHING A SEMICONDUCTOR MATERIAL WAFER

(71) Applicant: Siltronic AG, Munich (DE)

(72) Inventor: Juergen Schwandner, Garching (DE)

(73) Assignee: SILTRONIC AG, Munich (DE)

( * ) Notice: Subject to any disclaimer, the term of this patent is extended or adjusted under 35 U.S.C. 154(b) by 0 days.

(21) Appl. No.: 14/210,570

(22) Filed: Mar. 14, 2014

(65) Prior Publication Data

US 2014/0287656 A1 Sep. 25, 2014

(30) Foreign Application Priority Data

Mar. 19, 2013 (DE) ..... 10 2013 204 839

(51) Int. Cl.
*B24B 37/04* (2012.01)
*B24B 37/08* (2012.01)

(52) U.S. Cl.
CPC ..... *B24B 37/042* (2013.01); *B24B 37/08* (2013.01)

(58) Field of Classification Search
CPC ..... B24B 37/04; B24B 37/042; B24B 37/08; B24B 37/102; B24B 37/105; B24B 37/28; B24B 7/228; B24B 9/065
USPC ..... 451/41, 44, 57, 37, 268, 269
See application file for complete search history.

(56) References Cited

U.S. PATENT DOCUMENTS 3,691,694 A 9/1972 Goetz et al.
3,923,567 A 12/1975 Lawrence
3,997,368 A 12/1976 Petroff et al.
5,139,571 A 8/1992 Deal et al.
5,458,529 A 10/1995 Hasegawa et al.
5,882,539 A * 3/1999 Hasegawa et al. ..... 216/88
6,114,245 A * 9/2000 Vandamme et al. ..... 438/690
6,171,385 B1 1/2001 Rurlaender et al.
6,306,016 B1 10/2001 Steere, Jr. et al.
6,530,826 B2 3/2003 Wenski et al.
6,566,267 B1 5/2003 Wenski
6,753,256 B2 * 6/2004 Hashii et al. ..... 438/689
7,559,825 B2 * 7/2009 Erk et al. ..... 451/36
2002/0164930 A1 11/2002 Hakomori
2006/0040589 A1 2/2006 Ising
2007/0224821 A1 9/2007 Koyata et al.
2008/0305722 A1 12/2008 Roettger et al.

(Continued)

FOREIGN PATENT DOCUMENTS

DE 2628087 C2 1/1977
DE 69413311 T2 3/1999

(Continued)

*Primary Examiner* — Robert Rose
(74) *Attorney, Agent, or Firm* — Leydig, Voit & Mayer, Ltd.

(57) ABSTRACT

A method for polishing at least one semiconductor wafer while supplying a polishing agent includes performing a first simultaneous double-side polishing of the front side and the back side of the at least one semiconductor wafer with first upper and lower polishing pads, edge-notch polishing the surface of the at least one semiconductor wafer, performing a second simultaneous double-side polishing of the front side and the back side of the at least on semiconductor wafer with second upper and lower polishing pads, where the upper and lower polishing pads for the first simultaneous double-side polishing are harder and less compressible than the upper and lower polishing pads for the second simultaneous double-side polishing and performing single-side polishing of the front side of the at least one semiconductor wafer.

20 Claims, 1 Drawing Sheet

(56) References Cited

U.S. PATENT DOCUMENTS

| | | | | |
|---|---|---|---|---|
| 2009/0029552 | A1 | 1/2009 | Schwandner et al. | |
| 2009/0130960 | A1 | 5/2009 | Roettger et al. | |
| 2009/0311948 | A1* | 12/2009 | Hashii et al. | 451/44 |
| 2010/0330885 | A1 | 12/2010 | Schwandner | |
| 2011/0244762 | A1 | 10/2011 | Schwandner et al. | |
| 2012/0149198 | A1 | 6/2012 | Schwandner | |
| 2013/0109180 | A1 | 5/2013 | Tanimoto et al. | |
| 2013/0316521 | A1 | 11/2013 | Sasaki et al. | |

FOREIGN PATENT DOCUMENTS

| | | | |
|---|---|---|---|
| DE | 102009030294 | A1 | 1/2001 |
| DE | 19956250 | C1 | 5/2001 |
| DE | 10054166 | A1 | 10/2001 |
| DE | 10058305 | A1 | 6/2002 |
| DE | 10219450 | A1 | 11/2002 |
| DE | 102004040429 | A1 | 2/2006 |
| DE | 60123532 | T2 | 6/2007 |
| DE | 102007026292 | A1 | 12/2008 |
| DE | 102007035266 | A1 | 1/2009 |
| DE | 102007056122 | A1 | 5/2009 |
| DE | 102010014874 | A1 | 10/2011 |
| DE | 102010024040 | A1 | 12/2011 |
| EP | 0924759 | B1 | 6/1999 |
| EP | 1004400 | A1 | 5/2000 |
| JP | 2001332517 | A | 11/2001 |
| JP | 2011091143 | A | 5/2011 |
| JP | 2011216887 | A | 10/2011 |
| JP | 2012186338 | A | 9/2012 |
| JP | 2012223838 | A | 11/2012 |
| WO | WO 0047369 | A1 | 8/2000 |
| WO | WO 2011023297 | A1 | 3/2011 |
| WO | WO 2012005289 | A1 | 1/2012 |

* cited by examiner

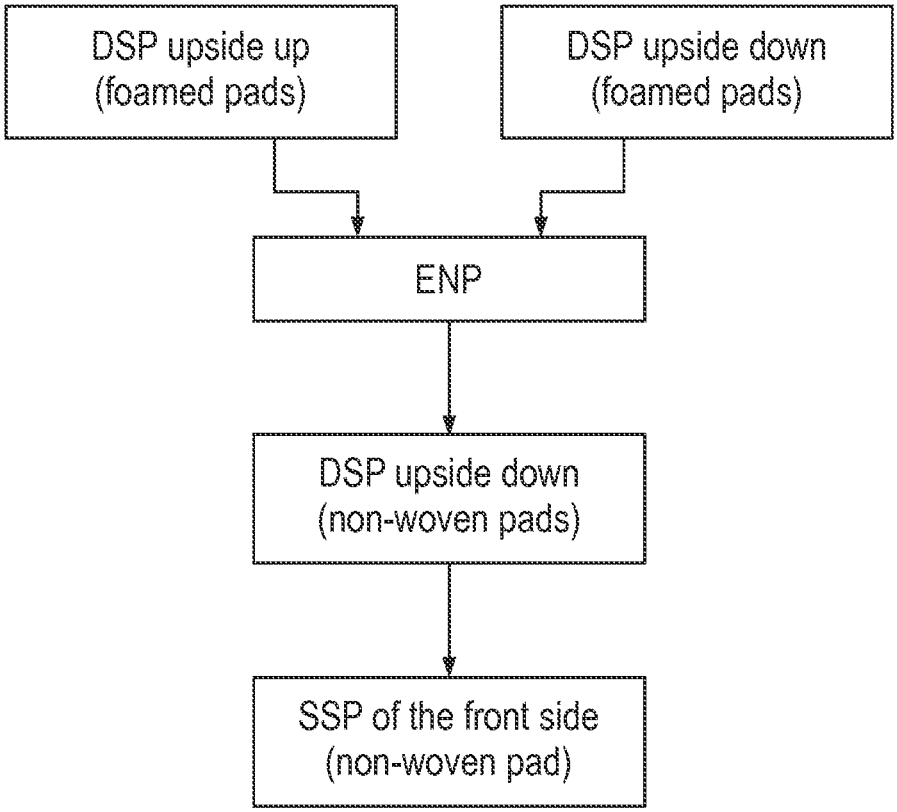
DSP upside up
(foamed pads)
DSP upside down
(foamed pads)
ENP
DSP upside down
(non-woven pads)
SSP of the front side
(non-woven pad)

METHOD FOR POLISHING A SEMICONDUCTOR MATERIAL WAFER

CROSS REFERENCE TO RELATED APPLICATIONS

This application claims priority from German Patent Application No. DE 10 2013 204 839.4 filed Mar. 19, 2013, which is hereby incorporated by reference herein in its entirety.

FIELD

The invention relates to a method for polishing a semiconductor material substrate, comprising a two-stage free-floating double-side polishing process (FF-DSP process) with edge-notch polishing between the two FF-DSP stages and final single-side finish polishing (mirror polishing) of the front side of the semiconductor material wafer. A method according to an embodiment of the invention is suitable for all wafer diameters, in particular for polishing semiconductor material wafers with a diameter of 300 mm or more.

BACKGROUND

For electronics, microelectronics and micro-electromechanics, semiconductor material wafers with extreme requirements for the global and local planarity (nanotopology), roughness (surface gloss) and purity (freedom from extraneous atoms, in particular metals) are required as starting materials (substrates). Semiconductor materials are compound semiconductors such as gallium arsenide or elemental semiconductors such as primarily silicon and sometimes germanium, or layer structures thereof.

Semiconductor material wafers are produced in a multiplicity of process steps, starting with the pulling of the crystal, through sawing of the crystal into wafers, to the surface preparation. The surface preparation is intended to achieve a defect-free, highly flat (planar) surface of the semiconductor wafer. The polishing is in this case one surface preparation method.

Corresponding processes for the production of semiconductor material wafers are described, for example, in the international applications WO 00/47369 A1 and WO 2011/023297 A1.

In double-side polishing (DSP), the front and back sides of a wafer are polished simultaneously. To this end, the wafer is guided in a carrier plate, the carrier plate being located in a working gap which is formed by the upper and lower polishing plates, each with a polishing pad applied thereon. Double-side polishing for semiconductor material wafers is described, for example, in U.S. Pat. No. 3,691,694 A.

In single-side polishing (SSP), only one side of a wafer is polished. For the single-side polishing of semiconductor material wafers, one or more wafers are fastened on a support plate, which may for example consist of aluminum or a ceramic. The fastening on the support plate is generally carried out by cementing the wafers by means of a layer of cement, and it is described for example in EP 0 924 759 B1. Single-side polishing for semiconductor material wafers is described, for example, in DE 100 54 166 A1 and US 2007/0224821 A2.

During polishing, material abrasion takes place usually by chemical-mechanical interaction (CMP) with the substrate surface. CMP is used, in particular, to remove surface defects and to reduce the surface roughness. CMP methods are described, for example in U.S. Pat. No. 6,530,826 B2 and in US 2008/0305722 A1.

During the chemical-mechanical polishing (CMP) of a semiconductor material substrate, the surface of at least one of a plurality of polishing pads may also contain fixed abrasives. Polishing operations with polishing pads which contain fixed abrasives are referred to as FA polishing operations. German patent application DE 10 2007 035 266 A1 describes, for example, a method for FA polishing of a silicon material substrate. In general, the polishing agent for FA polishing does not contain any additional abrasives.

If the surface of at least one of a plurality of polishing pads does not contain any fixed abrasives, then a polishing agent which contains abrasives is generally used (polishing slurry). A corresponding polishing agent is described, for example, in U.S. Pat. No. 5,139,571 A.

Polishing a semiconductor material wafer consists of at least two polishing steps, namely a first, material removal polishing step, the so-called stock polishing in which generally about 12-15 μm of material per wafer side is removed—either only on the front side or on the front and back sides—and subsequent mirror polishing (finish polishing), which leads to the defect reduction. During the mirror polishing, a reduction of the surface roughness is furthermore achieved. The mirror polishing is carried out with abrasions <1 μm, preferably ≤0.5 μm.

The integration of the simultaneous polishing of the front side and the back side (double-side polishing, DSP) into process sequences is used for the production of semiconductor material wafers.

The laid-open German specification DE 10 2010 024 040 A1 describes a multistage method for polishing a semiconductor material wafer, comprising the following steps in the order indicated: (a) simultaneous polishing of the front and back sides of the semiconductor wafer between two polishing plates, on each of which a polishing pad containing fixed abrasive particles is applied, an alkaline solution which is free of solids being supplied; (b) simultaneous polishing of the front and back sides of the semiconductor wafer between two polishing plates, on each of which a polishing pad is applied, an alkaline suspension which contains abrasive particles being supplied; (c) polishing of the front side of the semiconductor wafer on a polishing pad while supplying a suspension containing abrasive particles. Mirror polishing (finish polishing, CMP) is subsequently carried out by using soft polishing pads with total abrasion of from 0.3 to at most 1 μm per side, in which case the mirror polishing may be carried out as single-side or double-side polishing.

The German patent DE 199 56 250 C1 describes a multistage method for polishing a semiconductor material wafer, comprising the following steps: (a) simultaneous polishing of the front and back sides of the semiconductor wafer between two polishing plates in the presence of a polishing agent; (b) inspection of the semiconductor material wafers for the respective quality requirements; (c) further simultaneous polishing of the front and back sides of those semiconductor wafers which do not satisfy the quality features specified for further processing; (d) re-inspection of the semiconductor material wafers polished in step (c).

German Patent DE 199 56 250 C1, further describes the double-side polishing in step c) is carried out with the same parameters as the double-side polishing in step a) with further material abrasion of from 2 μm to 10 μm. However, Patent DE 199 56 250 C1 describes a method of double-sided polishing which only relates to the achieving of an optimal surface geometry without taking into account requirements for the roughness of the wafer surfaces.

In addition to polishing the front side and the back side of a semiconductor material wafer, the generally chamfered edge of the wafer, and if present the orientation notch, also need to be polished. For edge-notch polishing (ENP), the semiconductor material wafer is generally fixed centrally on a rotatable holding device (chuck). The edge of the semiconductor wafer extends beyond the chuck, so that it is freely accessible for the polishing device. Methods and devices for ENP are described for example in DE 10 2009 030 294 A1, DE 694 13 311 T2 and EP 1 004 400 A1.

The fixing of the wafer on a chuck for the edge and/or edge-notch polishing may, however, leave behind surface damage, for example in the form of imprints, on the side on which the fixing is carried out.

SUMMARY

In an embodiment the present invention provides a method for polishing at least one semiconductor wafer while supplying a polishing agent including performing a first simultaneous double-side polishing of the front side and the back side of the at least one semiconductor wafer with first upper and lower polishing pads, edge-notch polishing the surface of the at least one semiconductor wafer, performing a second simultaneous double-side polishing of the front side and the back side of the at least on semiconductor wafer with second upper and lower polishing pads, where the upper and lower polishing pads for the first simultaneous double-side polishing are harder and less compressible than the upper and lower polishing pads for the second simultaneous double-side polishing and performing single-side polishing of the front side of the at least one semiconductor wafer.

BRIEF DESCRIPTION OF THE DRAWINGS

The present invention will be described in even greater detail below based on the exemplary FIGURES. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

FIG. 1 summarizes the method according to an embodiment of the invention for polishing at least one semiconductor material wafer as a flowchart.

DETAILED DESCRIPTION

An aspect of the present invention is to provide an improved polishing method for polishing at least one semiconductor material wafer, including edge-notch polishing (ENP), which ensures semiconductor material wafers with both an optimal surface geometry and with a desired roughness and freedom from defects of the surface of the semiconductor material wafer.

In an embodiment, the present invention provides a method for polishing at least one semiconductor material wafer while supplying a polishing agent, comprising, in the order indicated, first simultaneous double-side polishing of the front side and the back side with a first polishing pad, edge-notch polishing, second simultaneous double-side polishing of the front side and the back side with a second polishing pad, and single-side polishing of the front side, wherein the upper and lower polishing pads for the first simultaneous double-side polishing are harder and less compressible than the upper and lower polishing pads for the second simultaneous double-side polishing.

A method according to an embodiment of the invention, used in order to achieve the object, will be explained in detail below together with a FIGURE. All the polishing steps in the method according to an embodiment of the invention are chemical-mechanical polishing steps (CMP steps).

A method according to an embodiment of the invention for polishing at least one semiconductor material wafer comprises, in the order indicated, first simultaneous double-side polishing step (FF-DSP 1), edge-notch polishing (ENP), a second simultaneous double-side polishing step (FF-DSP 2) carried out without force, and finish polishing (mirror polishing, SSP) carried out on one side (FIG. 1). A method according to an embodiment of the invention is suitable for any wafer diameter.

A semiconductor material wafer is conventionally a silicon wafer, or a substrate having layer structures derived from silicon, for example silicon-germanium (SiGe) or silicon carbide (SiC) or gallium nitride (GaN).

A semiconductor material wafer has a front side and a back side and—in general—rounded edges. The front side of the semiconductor material wafer is, by definition, the side on which the desired microstructures are applied in the subsequent customer processes. In the edge, there is a notch which is used for crystal orientation.

For simultaneous double-side polishing of at least one semiconductor material wafer, the wafer is placed in a suitably dimensioned recess of a carrier plate, which guides the wafer during the polishing.

The carrier plate preferably consists of a material which is as light as possible but sufficiently rigid, for example titanium, and is located in a working gap which is formed by the upper and lower polishing plates, each with a polishing pad applied thereon.

During the simultaneous double-side polishing of the front side and the back side of at least one semiconductor material wafer, this wafer can move "freely floating" in the suitably dimensioned recess of the carrier plate. This method is therefore also referred to as a free-floating method (FF-DSP).

The simultaneous double-side polishing of the front side and the back side of at least one semiconductor material wafer may be ended in positive jut-out or negative jut-out.

When the simultaneous double-side polishing is ended in positive jut-out, the semiconductor material wafer placed in the suitably dimensioned recess is thicker than the carrier plate, that is to say the side of the wafer facing toward the upper polishing pad is higher than the corresponding side of the carrier plate.

When using a hard and incompressible polishing pad, the positive jut-out has advantages in respect of the wafer geometry achievable by the double-side polishing and in respect of the material interaction between the substrate to be polished and the polishing pad, since no direct contact takes place between the polishing pad and the carrier plate.

One disadvantage of double-side polishing in positive jut-out, particularly in the case of softer and more compressible polishing pads, can be an undesired edge roll-off due to the wafer sinking into the polishing pad.

When the polishing is ended in negative jut-out, the semiconductor material wafer placed in the suitably dimensioned recess is thinner than the carrier plate, so that undesired edge roll-off in the case of softer and more compressible polishing pads is reduced significantly, since the polishing pad is supported by the edge of the suitably dimensioned recess of the carrier plate, deforms less strongly and therefore experiences pressure relief at the outermost edge of the wafer.

However, polishing in negative jut-out leads to increased wear of the carrier plate coating, since the polishing pad acts surface-wide and directly on the carrier plate surface. This can lead to undesired particle generation, up to metal contamination of the wafer.

In the case of simultaneous double-side polishing, the upper polishing pad is structured in order to avoid adhesion of the polished wafer on the upper polishing plate, while the lower polishing pad has a smooth surface.

In a method according to an embodiment of the invention, hard and incompressible polishing pads made of a foamed polymer, for example polyurethane (PU), are used for the first simultaneous polishing of the front and back sides (FF-DSP 1) of the at least one semiconductor material wafer (substrate).

In the context of this invention, a hard polishing pad has a hardness of more than 80 Shore A and an incompressible polishing pad has a compressibility of at most 3%. The compressibility of a material describes the pressure change on all sides which is necessary in order to cause a particular volume change. The calculation of the compressibility is carried out in a similar way to the standard JIS L-1096 (Testing Methods for Woven Fabrics).

Hard and incompressible polishing pads are therefore used in the context of the invention for the first simultaneous polishing of the front and back sides (FF-DSP 1). They consist, for example, of polyurethane foam and generally do not contain an inlay of fiber non-woven. Examples are pads of the PRD series from the manufacturer Nitta-Haas Inc. (Japan), for example the pad PRD-N015A.

Particularly when using hard and incompressible polishing pads, it is of particular importance to ensure a plane-parallel working gap, since these polishing pads replicate position differences of the two polishing plates with respect to one another directly on the polishing gap geometry.

The polishing process is therefore preferably carried out with active polishing gap control. This comprises contactless measurement of the distance between the upper and lower polishing plates at least at two, preferably three or more, radial positions during the polishing process. The contactless measurement is preferably carried out by means of eddy current sensors. On the basis of the measured radial profile of the distance, the shape of at least one of the two polishing plates is actively readjusted in order to achieve a maximally constant spacing of the two polishing plates over the entire radius. To this end, in general, the shape of the upper polishing plate is adjusted and adapted to the shape changes of the lower working disk, which are initiated for example by the input of heat during the polishing process. A polishing device having active working gap control of this type is described in DE 10 2004 040 429 A1. The distance measurement by means of eddy current sensors works particularly well when at least the inner part of the carrier plates does not consist of metal, since metal parts in the working gap interfere with the measurement.

The active working gap control is preferably combined with preconditioning of the polishing agent to a defined temperature, in order to avoid short-term temperature variations initiated by the polishing agent. Preferably, the polishing agent is brought to the predetermined temperature by means of a heat exchanger before delivery into the working gap. This may in turn advantageously be combined with polishing agent recycling, used polishing agent being discharged, collected, thermally regulated and returned to the working gap. In this way, a cost saving and temperature stabilization can be achieved simultaneously.

For the first simultaneous polishing of the front and back sides (FF-DSP 1) of the at least one semiconductor material wafer (substrate), in a first embodiment, the at least one semiconductor material wafer is placed in a suitably dimensioned recess of a carrier plate in such a way that the front side of the semiconductor material wafer is polished on the structured upper polishing pad during the polishing process (upside up).

When the semiconductor material wafer is polished upside up, the double-side polishing may be carried out in such a way that the fully polished wafer is in positive jut-out or negative jut-out with respect to the carrier plate.

For the first simultaneous polishing of the front and back sides (FF-DSP 1) of the at least one semiconductor material wafer (substrate), in a second embodiment, the at least one semiconductor material wafer is placed in a suitably dimensioned recess of a carrier plate in such a way that the front side of the semiconductor material wafer is polished on the smooth lower polishing pad during the polishing process (upside down).

When the semiconductor material wafer is polished upside down, the double-side polishing may be carried out in such a way that the fully polished wafer is in positive jut-out or negative jut-out with respect to the carrier plate.

For the polishing process according to the invention, an alkali-loaded but particulately diluted aqueous silica sol suspension is preferably used as polishing agent in conjunction with an alkaline buffer and a strong alkali.

The proportion of the abrasive in the polishing agent dispersion for the first double-side polishing step (FF-DSP 1) is preferably from 0.25 to 20 wt %, particularly preferably 0.4-5 wt %. The size distribution of the abrasive particles is preferably monomodal. The average particle size is from 5 to 300 nm, particularly preferably from 5 to 50 nm. The abrasive consists of a material which mechanically abrades the substrate material, preferably one or more of the oxides of the elements aluminum, cerium or silicon.

A polishing agent dispersion which contains colloidally dispersed silica is particularly preferred. The pH of the polishing agent dispersion preferably lies in a range of from 9 to 12.5, particularly preferably in the range of from 11 to 11.5, and is preferably adjusted by additives such as sodium carbonate ($Na_2CO_3$), potassium carbonate ($K_2CO_3$), sodium hydroxide (NaOH), potassium hydroxide (KOH), ammonium hydroxide ($NH_4OH$), tetramethylammonium hydroxide (TMAH) or any desired mixtures of these compounds.

The polishing agent dispersion may furthermore contain one or more further additives, for example surface-active additives such as wetting agents and surfactants, stabilizers acting as protective colloids, preservatives, biocides, alcohols and sequestrants.

The polishing pressure in the first, material removal polishing step, during the stock polishing and with a supply of the polishing agent, is preferably from 0.10 to 0.5 bar, and particularly preferably 0.10-0.30 bar.

Preferably, the polishing agent is reused by means of a polishing agent recycling system and furthermore refreshed with potassium hydroxide.

Preferably, the first simultaneous double-side polishing of the at least one semiconductor material wafer is carried out in a temperature range of 20° C.-30° C., particularly preferably from 22° C. to 25° C.

Preferably, material abrasion of from 8 to 12 μm per side takes place during the first simultaneous polishing of the front and back sides (FF-DSP 1) of the at least one semiconductor material wafer.

In order to stop the first stock polishing step, an abrasion stop step based on silica sol stabilized with surfactants, for example Glanzox 3900 from the company Fujimi, Japan, is preferably carried out.

Particularly preferably, the stopping of the first stock polishing step is carried out with deionized water with the purity required for use in the silicon industry (DI water, DIW).

In this case, the surface of the semiconductor material wafer is to be kept wet until the start of the next process step, in order to prevent drying deposits, for example due to polishing agent residues still present.

By the first simultaneous polishing of the front and back sides (FF-DSP 1) of the at least one semiconductor material wafer, the geometry of the wafer is optimized. The use of hard and incompressible polishing pads in this first step of a method according to an embodiment of the invention leads, in particular, to an improved edge geometry.

However, the use of hard and incompressible polishing pads leads to the roughness of the polished front side and back side still being too high after the first double-side polishing step.

In a polishing method according to an embodiment of the invention, the first simultaneous double-side polishing step (FF-DSP 1) is followed by edge-notch polishing (ENP).

For the edge-notch polishing, the semiconductor material wafer is preferably fastened by a vacuum with its front side on a centrally rotating chuck.

For the edge-notch polishing, the semiconductor material wafer is particularly preferably fastened by a vacuum with its back side on a centrally rotating holding device (chuck). The edge of the semiconductor wafer extends beyond the chuck, so that it is freely accessible for the polishing device.

At least one edge surface of the centrally rotating wafer is pressed with a particular force (application pressure) against a polishing device, which may be stationary (polishing jaw) or may likewise centrally rotate (polishing drum). A polishing pad is applied on the polishing device for polishing an edge or the notch.

Devices and methods for edge-notch polishing are described for example in the German applications DE 10 2009 030 294 A1 and DE 102 19 450 A1, as well as in the document DE 601 23 532 T2.

The fastening of a semiconductor material wafer on a chuck may lead to imprints of the chuck, the so-called chuck marks, on the side touching the chuck. The surface defects produced in the form of chuck marks in an ENP process must then be removed reliably by subsequent polishing, in order to achieve the desired surface quality.

In a method according to an embodiment of the invention for polishing at least one semiconductor material wafer, second free-floating double-side polishing (FF-DSP 2) is carried out after the edge-notch polishing, the front side of the semiconductor material wafer being polished on the smooth lower polishing pad in this polishing step (upside down).

To this end, the at least one semiconductor material wafer is again placed in a suitably dimensioned recess of a carrier plate, which is located in a working gap of a double-side polishing machine.

The second double-side polishing step is used on the one hand to reduce the increased roughness of the front and back sides (Chapman filter 30-250 μm/DIC haze [ppm]/haze [ppm]) caused by the first double-side polishing step (FF-DSP 1) and, on the other hand, to remove potentially present polishing scratches which may be caused by the use of the hard and incompressible polishing pads, as well as to remove chuck marks.

In the second double-side polishing step of a method according to an embodiment of the invention, a structured polishing pad is applied on the upper polishing plate and a smooth polishing pad is applied on the lower polishing plate. By virtue of the structure in the surface of the upper polishing pad, adhesion of the semiconductor material wafer on the upper pad is avoided.

As polishing pads for this second polishing step (FF-DSP 2), preferably non-woven pads impregnated with a polymer, for example polyurethane (PU), are applied on the upper and lower polishing plates.

It is also preferred to apply for this second polishing step (FF-DSP 2) foamed polishing pads which consist, for example, of polyurethane foam and generally do not contain an inlay of fiber non-woven.

According to the invention, these polishing pads for this second double-side polishing step have a hardness of less than or equal to 80 Shore A and a compressibility of more than 3%, and are therefore softer and more compressible than the foamed polishing pads from the first double-side polishing step of a method according to an embodiment of the invention.

Suitable non-woven polishing pads impregnated with polymer for the second polishing step are, for example, SUBA polishing pads of the MH series from the company Dow Chemical Company, USA.

Suitable foamed polishing pads for the second polishing step are, for example, pads of the PRD series from the manufacturer Nitta-Haas Inc. (Japan), for example the pad PRD-N015A.

In case that a foamed polishing pad is used for the second double-side polishing step, the less hardness and the less compressibility as compared to the foamed polishing pads of the first polishing step is preferably achieved by electing a foamed polishing pad with the required hardness and compressibility.

Even preferred is the achievement of the less hardness and the less compressibility as compared to the foamed polishing pads of the first polishing step by performing the second double-side polishing step at a higher temperature as compared to the first double-side polishing step. With the higher temperature as compared to the first double-side polishing step, especially if the same polishing pad is used for both double-side polishing steps, both the hardness and the compressibility of the foamed polishing pad is reduced. The reduction of both hardness and compressibility can be controlled by the polishing temperature, i.e. the higher the temperature the lesser the hardness and compressibility.

Preferably, the second simultaneous double-side polishing of the at least one semiconductor material wafer is carried out in a temperature range of 20° C.-60° C., particularly preferably from 30° C. to 45° C.

In the second double-side polishing step (FF-DSP 2), an alkali-loaded, diluted polishing agent suspension based on silica sol ($SiO^2$), for example Glanzox 3900 from the company Fujimi, Japan, is used in combination with an alkaline buffer, for example $K_2CO_3$.

The polishing agent for the second double-side polishing step (FF-DSP 2) does not contain a strong alkali, such as for example KOH. The use of a strong alkali in the second double-side polishing step (FF-DSP 2) can lead to a large increase in the pH, so that uncontrolled etching of the edge already optimized by the edge-notch polishing may occur during the second double-side polishing taking place.

The proportion of the abrasive in the polishing agent dispersion for the second double-side polishing step (FF-DSP 2) is preferably from 0.25 to 20 wt %, particularly preferably 0.4-5 wt %. The size distribution of the abrasive particles is preferably monomodal. The average particle size is from 5 to 300 nm, particularly preferably from 5 to 50 nm. The abrasive consists of a material which mechanically abrades the substrate material, preferably one or more of the oxides of the elements aluminum, cerium or silicon.

A polishing agent dispersion which contains colloidally dispersed silica is particularly preferred. The pH of the polishing agent dispersion preferably lies in a range of from 10 to 11, and is preferably adjusted by additives such as sodium carbonate ($Na_2CO_3$), potassium carbonate ($K_2CO_3$), or any desired mixtures of these compounds.

The polishing agent dispersion may furthermore contain one or more further additives, for example surface-active additives such as wetting agents and surfactants, stabilizers acting as protective colloids, preservatives, biocides, alcohols and sequestrants.

The polishing pressure in the second double-side polishing step (FF-DSP 2) is preferably from 0.1 to 0.4 bar with a polishing time of at most 10 minutes. Preferably, the polishing time of the second double-side polishing step is from 1 to 6 minutes, particularly preferably from 1 to 4 minutes.

Preferably, material abrasion of no more than 2 μm per side takes place during the second simultaneous polishing of the front and back sides (FF-DSP 2) of the at least one semiconductor material wafer. Material abrasion of from 0.5 to 1 μm per wafer side is particularly preferred.

The second simultaneous polishing of the front and back sides (FF-DSP 2) of the at least one semiconductor material wafer is used on the one hand to remove scratches and the chuck mark possibly present, and on the other hand to reduce the roughness of the surface.

After the second double-side polishing step has been carried out, a geometry measurement of the semiconductor material wafer may take place. Preferably, the geometry measurement is carried out by random sampling, for example one random sample per polishing run.

The geometry measurement is used to control the subsequent polishing step, final mirror polishing (finish polishing).

In a second embodiment of a method according to an embodiment of the invention, instead of the second simultaneous polishing of the front and back sides (FF-DSP 2) of the at least one semiconductor material wafer, the back side of the wafer is provided with a getter. The application of the getter may be carried out mechanically by roughening or by depositing a layer, for example polysilicon. Methods for applying a getter are described, for example, in U.S. Pat. No. 3,923,567 A and DE 26 28 087 C2.

The final mirror polishing of the method according to an embodiment of the invention for polishing at least one semiconductor material wafer is carried out as single-side polishing (SSP) of the front side, and is used for further minimization of the roughness of the front side of the at least one semiconductor material wafer.

The single-side polishing is carried out in a method according to an embodiment of the invention as typical chemical-mechanical polishing (CMP) with soft polishing pads which contain no abrasives, and in the presence of a polishing agent.

CMP methods are described, for example, in the German applications DE 100 58 305 A1 and DE 10 2007 026 292 A1.

Preferably, the total abrasion on the front side of the semiconductor material wafer in this final step is from 0.01 μm to 1 μm, particularly preferably from 0.05 μm-0.2 μm.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed:

1. A method for polishing at least one semiconductor wafer while supplying a polishing agent comprising the following steps in the order of:

a) performing a first simultaneous double-side polishing of the front side and the back side of the at least one semiconductor wafer with first upper and lower polishing pads;

b) edge polishing, notch polishing, or edge and notch polishing a surface of the at least one semiconductor wafer;

c) performing a second simultaneous double-side polishing of the front side and the back side of the at least one semiconductor wafer with second upper and lower polishing pads, the upper and lower polishing pads for the first simultaneous double-side polishing being harder and less compressible than the upper and lower polishing pads for the second simultaneous double-side polishing, and;

d) performing single-side polishing of the front side of the at least one semiconductor wafer.

2. The method as recited in claim 1, wherein the polishing pads for the first simultaneous double-side polishing include a foamed polymer with a hardness of at least 80 Shore A and a compressibility of at most 3%.

3. The method as recited in claim 1, wherein the polishing pads for the second simultaneous double-side polishing include a foamed polymer having a hardness of less than 80 Shore A and having a compressibility of more than 3% during the second polishing step.

4. The method as recited in claim 1, wherein the front side of the at least one semiconductor wafer is polished on the upper polishing pad during the first simultaneous double-side polishing.

5. The method as recited in claim 1, wherein the polishing agent for the first simultaneous double-side polishing contains a strong alkali.

6. The method as recited in claim 1, wherein material abrasion of from 8 μm to 12 μm per side takes place during the first simultaneous double-side polishing.

7. The method as recited in claim 1, wherein material abrasion of no more than 1 μm takes place during the single-side polishing of the front side.

8. The method as recited in claim 1, wherein the polishing temperature of the second simultaneous double-side polishing is in the range of 20° C. to 60° C.

9. The method as recited in claim 1, comprising:

edge polishing.

10. The method as recited in claim 1, comprising:

notch polishing.

11. The method as recited in claim 1, comprising:

edge and notch polishing.

12. The method as recited in claim 1, wherein the polishing pads for the second simultaneous double-side polishing include of a polymer-impregnated fiber non-woven with a hardness of less than 80 Shore A and a compressibility of more than 3%.

13. The method as recited in claim 2, wherein the polishing pads for the second simultaneous double-side polishing include of a polymer-impregnated fiber non-woven with a hardness of less than 80 Shore A and a compressibility of more than 3%.

14. The method as recited in claim 2, wherein the polishing pads for the second simultaneous double-side polishing include a foamed polymer having a hardness of less than 80 Shore A and having a compressibility of more than 3% during the second polishing step.

15. The method as recited in claim 1, wherein the polishing agent for the first simultaneous double-side polishing contains a KOH.

16. The method as recited in claim 1, wherein the polishing agent for the second simultaneous double-side polishing does not contain a strong alkali.

17. The method as recited in claim 5, wherein the polishing agent for the second simultaneous double-side polishing does not contain a strong alkali.

18. The method as recited in claim 1, wherein material abrasion of no more than 2 μm per side takes place during the second simultaneous double-side polishing.

19. The method as recited in claim 6, wherein material abrasion of no more than 2 μm per side takes place during the second simultaneous double-side polishing.

20. The method as recited in claim 1, wherein an average particle size of an abrasive in the second double-side polishing is in a range of from 5 to 50 nm, and wherein the abrasive comprises an aluminum oxide, a cerium oxide, a silicon oxide, or a mixture of two or more of any of these.

* * * * *